United States Patent [19]

Adams

[11] 4,406,333

[45] Sep. 27, 1983

[54] ROTATING HEAD FOR ROTARY DRILLING RIGS

[76] Inventor: Johnie R. Adams, P.O. Box 6202, Ft. Smith, Ark. 72906

[21] Appl. No.: 310,386

[22] Filed: Oct. 13, 1981

[51] Int. Cl.[3] ..... E21B 33/068

[52] U.S. Cl. ..... 175/209; 277/31; 166/84

[58] Field of Search ..... 166/82, 83, 84; 175/195, 209, 210; 464/180, 184; 277/31

[56] References Cited

U.S. PATENT DOCUMENTS 2,243,439 5/1941 Pranger et al. ..... 277/31

2,846,247 8/1958 Davis ..... 277/31 X

*Primary Examiner*—Stephen J. Novosad

*Assistant Examiner*—Joseph Falk

*Attorney, Agent, or Firm*—Robert R. Keegan

[57] ABSTRACT

There is disclosed a rotating head for a rotary drilling rig which is to be secured to the top of the well pipe having an inner rotating portion with an opening therethrough which permits passage of drill pipe, pipe joints, and Kelly tools; the rotating portion has an annular drive rubber formed integrally with the top portion thereof. A rotating head drive bushing having an opening with a cross-sectional shape generally conforming to the cross-section of the Kelly tool to permit only sliding motion therebetween is provided with helical external ridges which produce a disengagable gripping action with the opening in the drive rubber at the top of the rotating portion of the rotating head. The rotating portion has a conventional stripper rubber at the bottom thereof and is mounted with a double roller bearing to provide low friction motion with respect to the fixed portion of the head. The double roller bearing is lubricated with a viscous lubricating material and paddles are provided between the sets of rollers of the double roller bearing for distributing the viscous lubricating material and in particular propel it onto the upper set of bearings; the upper body portion of the rotating head is readily detachable from the lower sleeve portion which is normally welded to the well conductor pipe.

17 Claims, 4 Drawing Figures

ROTATING HEAD FOR ROTARY DRILLING RIGS

The present invention relates to rotary drilling equipment primarily used in drilling oil and gas wells. In such an operation a drill tool at the bottom of the hole is connected to a string of drill pipe through which downwardly flows a fluid medium pumped under high pressure; the drill pipe also serves to rotate the drill tool. The drilling fluid may be either liquid "mud" or air (or other gas). As the drill tool bores through the earth the fragments or cuttings are carried to the top of the hole by the drilling fluid.

At least the upper portion of the hole is provided with a well conductor pipe through which the fragments and cuttings are lifted. The present invention is most commonly used in an operation where the drilling fluid is air. It may, however, be used in an operation utilizing drilling "mud" also.

It is desirable to provide a means to carry the earth and cuttings away from the top of the hole and the drilling platform since they would otherwise soon accumulate and impede the operation. One purpose of a rotating head is to facilitate handling the air (or mud) flowing upward through the well pipe. In the case of mud it is necessary for it to be re-circulated. Re-circulation is obviously not necessary for the air stream. However, it is desirable that the air stream carrying the earth and cuttings be conducted at least a short distance from the hole in order that the accumulation not impede the drilling operation. A pipe of six inch diameter, more or less, provided for this purpose is referred to as a blewie line.

At the top of the drill stem there is connected a Kelly tool which is a hollow steel tube of non-circular outer cross-section, normally square. The Kelly tool fits in a hole of similar cross-section in the drill rig turntable and is the means by which the motive power is applied to rotate the drill stem (which may be a mile or more in length), and the drilling tool at the bottom of the hole. Massive pulley blocks, cable and hoist apparatus, referred to as draw works, raise and lower the Kelly tool, the drill stem and the drilling tool.

The rotating head provides a reasonably tight seal at the top of the well pipe while permitting the Kelly tool to rotate therein. The top of the well pipe is referred to as the conductor pipe and the rotating head is provided with a fixed pipe which may be of 16 inch diameter, or thereabout, which is welded or otherwise secured to the conductor pipe. The fixed pipe will customarily be provided with a blewie line flange extending horizontally therefrom to provide a fixed non-rotating attachment point for the blewie line.

The arrangement thus far described above is generally conventional but the prior art arrangements of this apparatus have defects and disadvantages which are remedied by novel features of the particular rotating head structure provided by the present invention. The typical prior rotating head has a rotating portion with an unyielding metal connection to a rotating head drive bushing element with a square opening therein for the Kelly drive. A great deal of vibration is produced in such an apparatus as the Kelly drive rotates the rotating portion of the rotating head with all metal-to-metal contact between the parts of the elements communicating the rotating forces to the rotating portions. As will be seen, the present invention provides a cushioned coupled between a rotating head bushing and the rotating portion of the rotating head which greatly reduces vibration and provides a smoother operating mechanism.

Prior apparatus provided a bearing for rotational movement between the rotating portion and the fixed portion of the device which produced a great deal of friction and required lubrication with a flowing re-circulated lubricant. Imperfect seals in the rotary joints between the rotating and fixed portion caused substantial leakage and loss of substantial quantities of lubricating oil during the drilling operation. Applicant's apparatus is arranged on the other hand so that tighter lubricant seals may be provided thereby sealing the lubricant in the bearing housing and reliably preventing the entrance of dirt or other contaminants into the bearing lubricant. The lubricant is preferably a viscous lubricant such as a petroleum derived grease. This alleviates the problem of providing a flowing lubricant and the loss of flowing lubricant due to imperfect seals.

The continued effectiveness of the lubricant is insured by a paddle structure within the rotating portion of the apparatus which distributes the lubricant and prevents it from gravitating to the bottom of the bearing housing. It is contemplated that the rotating head will be used for several weeks of heavy duty drilling operation before it will require maintenance, at which time it will be removed and replaced by a reconditioned rotating head. The rotating head removed from service will then in turn be reconditioned with addition or replacement of lubricating grease, replacement of seals and any other reconditioning that might be required. The drilling operation is thus provided with a reliable rotating head device which is carefree and requires no supply of flowing lubricating oil for operation. This provides a valuable improvement to the drilling equipment since it removes a likely source of breakdown which could interrupt drilling operations for several hours or longer at a cost of hundreds of dollars an hour.

To facilitate the removal of the rotating head for replacement with a reconditioned head, bolts and lugs are provided to detach the rotating head body from the lower pipe portion which has been welded to the conductor pipe. The lower pipe portion is left in place and a reconditioned rotating head body portion is secured in place of the one being removed.

In addition to providing the advantages and features described above, it is an object of the present invention to provide a rotating head for rotary drilling operations which has a sealed roller bearing assembly containing a viscous lubricant and is provided with paddles within the housing which propel the lubricant upwardly and distribute it for thorough lubrication of the bearing apparatus.

It is another object of the present invention to provide a rotating head for rotary drilling operations which does not require a flowing lubricant and in which the lower portion may be permanently secured to the conductor pipe by welding or the like and the upper portion is readily removable therefrom to replace the upper portion with a substantially identical lubricated and/or reconditioned rotating head mechanism.

It is still another object of the present invention to provide a rotating head for rotary drilling operations in which the rotating portion thereof has a drive rubber in the form of an annular grommet at the top thereof and wherein a rotating head drive bushing is provided which engages the drive rubber through helical ridges on the lower external portion of the rotating head drive bushing.

It is yet another object of the present invention to provide a rotating head for rotary drilling operations in which conventional grease seals are provided to seal viscous lubricating grease within the roller bearing housing structure and in addition thereto O-ring dust seals are provided to protect the bearing from ingress of dirt or other abrasive material, such O-rings being readily replaceable when the rotating head is removed from service for re-lubrication and/or reconditioning.

Other objects and advantages of the present invention will be apparent from consideration of the following description in conjunction with the appended drawings in which.

Figure 1:
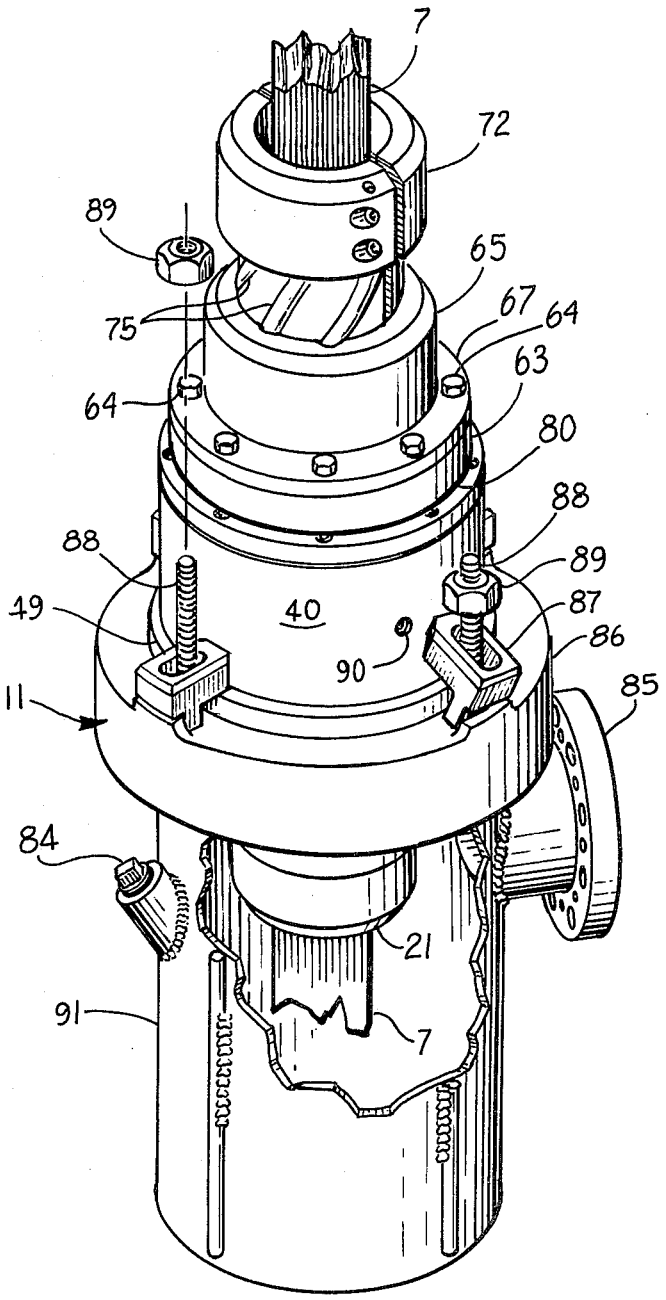
FIG. 1 is an isometric view partially cut away of a rotating head according to the present invention.

Referring now to the drawings and particularly FIG. 1, a rotating head 11 according to the invention is shown in an isometric partially cut away view. A sleeve 91 formed of large heavy duty steel pipe is of a diameter sufficient to pass the drill bit or any other tool to be placed down the hole. Sleeve 91 is secured to the top of a well conductor pipe by welding or other suitable means. A heavy flange 85, which may be of six inch diameter, is welded over an opening in the side or sleeve 91. Flange 85 provides a connection for a blewie line through which passes the high velocity air from the drill bit at the bottom of the hole carrying soil fragments and cuttings created by action of the drill bit.

The rotating head according to the invention may also be used in operations where drilling mud is employed. A pipe plug 84 in the side of sleeve 91 is provided for a fill up line used in mud drilling operations. In some cases the sleeve 91 will not be welded directly to the well conductor pipe, but there will be intervening drilling apparatus such as a blow-out preventor or the like. The presence of such apparatus does not affect the operation of the rotating head described hereinafter.

A bowl flange 86 forms the top of sleeve 91 and has secured thereto connector bolts 88 on which are nuts 89. Nuts 89 are preferably captured on bolts 88 by pins or the like to prevent their removal. Bolts 88 and nuts 89 serve to hold and tighten locking blocks 87 which are provided with oval openings permitting them to be raised when nuts 89 are loosened as shown in FIG. 1 and rotated to an inoperative position. Bearing housing 40 has a rim 49 which is engaged by blocks 87 to hold housing 40 very securely seated in bowl flange 86. Portions of the apparatus thus far described are fixed and do not rotate with the Kelly tool and the drill pipe.

The rotating portion of the rotating head includes a stripper rubber 21 of generally conventional form. The stripper rubber provides a seal around the Kelly tool while permitting the Kelly tool 7 (and the drill pipe) to slide up and down through it. It is a conventional component formed of rubber or other elastomeric material. It is available from Triple M Oil Tool Company in Odessa, Tex., and from other sources.

The rotating portion of the rotating head also includes upper end nut 63 to which there is attached a drive rubber element 65. Drive rubber element 65 is formed of a semi-rigid elastomeric material such as rubber secured by adhesive or other suitable means to a metal flange 67, and is bolted in place through holes in flange 67 by bolts 64.

The topmost element of the rotating head is a rotating head bushing 72 of novel construction. It has an opening with a configuration to fit the Kelly tool 7 being utilized in the drilling operation such that the Kelly tool 7 is free to slide up and down in bushing 72, but is constrained so that there is no relative rotational movement between rotating head tool 7 and Kelly drive bushing 72 and thus bushing 72 has a rotating motion imparted by Kelly tool 7.

Rotating head drive bushing 72 preferably is formed of steel in two parts bolted together so that it may be readily dissembled and removed from the rotating head tool 7. The bottom portion of Kelly drive bushing 72 is generally cylindrical and has a diameter slightly less than the internal diameter of the drive rubber element 65. It is provided with helical ribs 75 so that a clockwise motion of rotating head drive bushing 72 causes it to thread itself into drive rubber element 65 producing a strong frictional connection which results in drive rubber element 65 and the rotating portion of the rotating head turning along with rotating head drive bushing 72 and Kelly tool 7.

It should be noted that while there is very firm frictional engagement between rotating head drive bushing 72 and drive rubber element 65, it is not a solid mechanical connection. Thus if for any reason the bearing in the rotating head locked up so that the rotating head could not be readily rotated by the rotating head drive bushing, the weakest point of the connection would be the drive rubber element which would slip and prevent damage to other elements of the apparatus. If damage occurred to the drive rubber element, it is a simple matter to replace that element. Serious damage to other components is thereby prevented.

Figure 2:
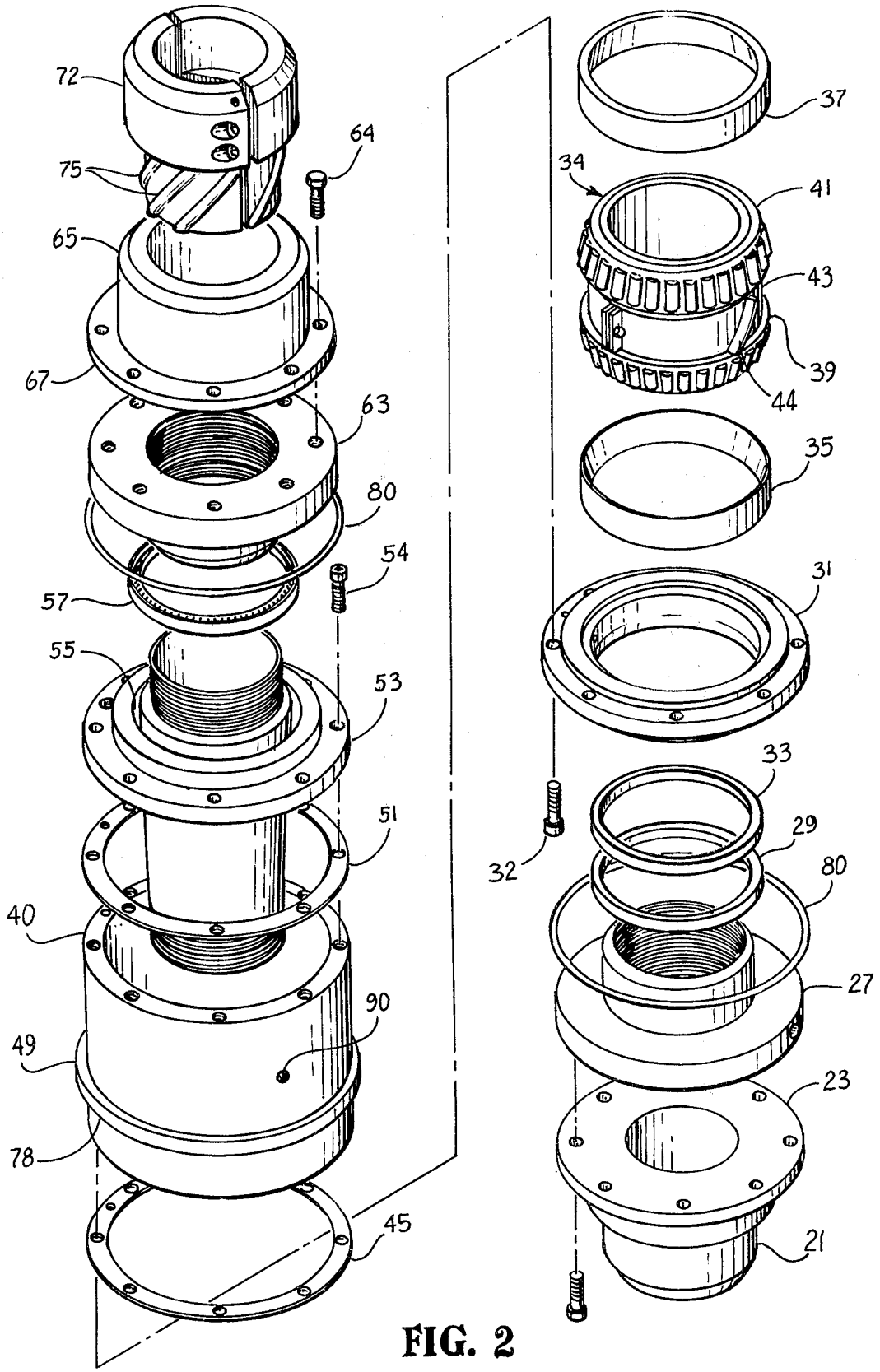
FIG. 2 is an exploded view of the apparatus of FIG. 1 except for lower sleeve portion and the blewie pipe flange.
Figure 3:
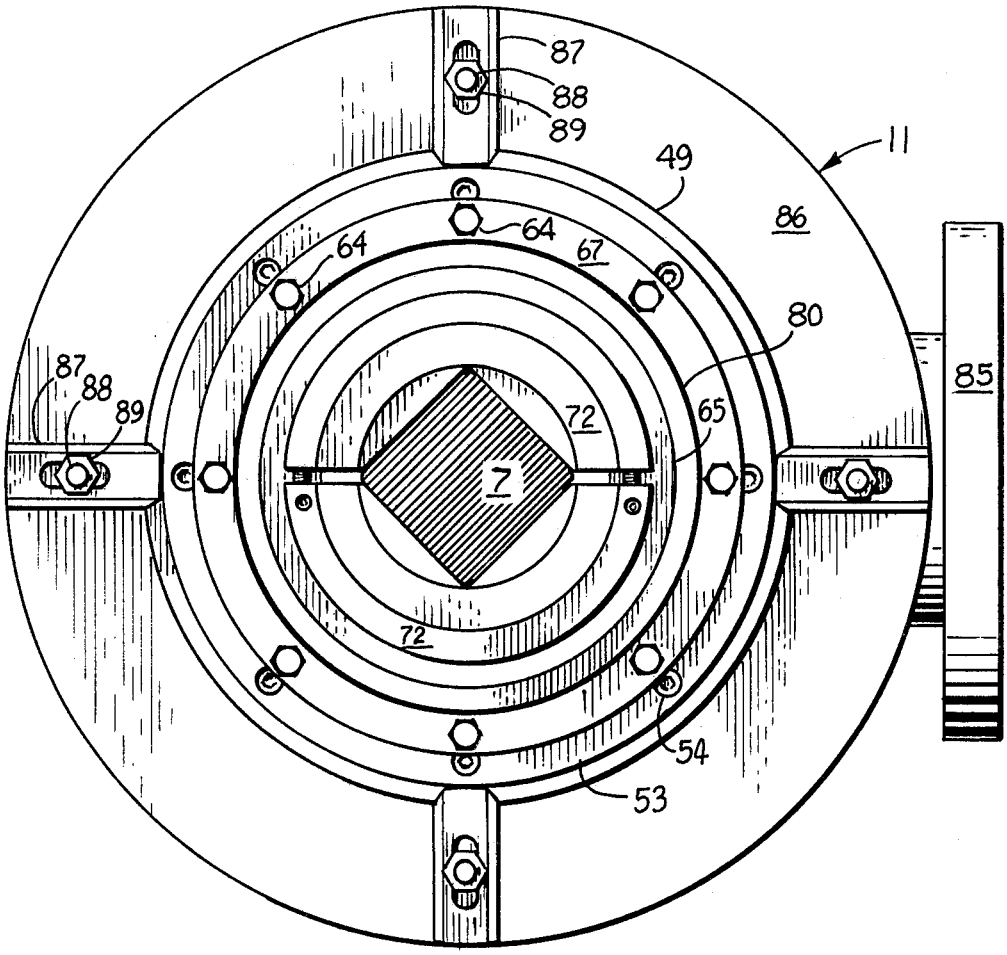
FIG. 3 is a top plan view of the apparatus of FIG. 1.
Figure 4:
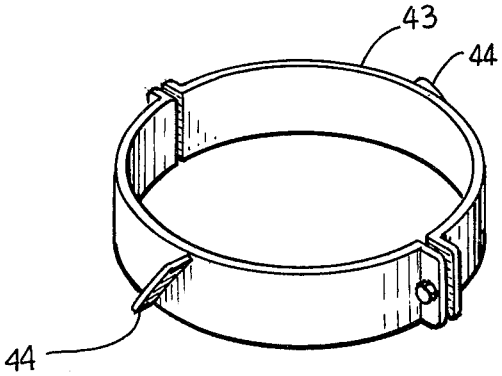
FIG. 4 is an enlarged detailed isometric view of the paddle structure shown in FIG. 2.

The details of construction of the rotary head may be better seen in FIGS. 2, 3, and 4. The elastomeric portion of stripper rubber 21 is secured to a metal flange 23 by a suitable adhesive or other means. Bolts 24 pass through holes in flange 23 into tapped holes in a lower end nut 27. Stripper rubber 21 and lower end nut 27 are thereby firmly secured together and at the same time stripper rubber 21 may be replaced without difficulty. A gasket may be provided if desired between flange 23 and end nut 27.

End nut 27 is internally threaded to engage mating threads on a drive ring 61. The bottom of bearing housing 40 is closed by lower end plate 31 having openings to accommodate cap bolts 32 which thread into tapped openings in the bottom of bearing housing 40 (the bottom openings are not shown but are the same as those in the top shown in FIG. 2). End plate 31 is a fixed element while lower end nut 27 is a rotating element and a rotating seal therebetween is provided by grease seals 29 and 33 which are identical. Each grease seal 29 and 33 may be selected from readily available components and for example may be a Garlock 11″×10″ Grease Seal, Standard, made by Garlock Seal Manufacturing Co. A dirt seal is provided for the junction of lower end plate 31 and lower end nut 27 by O-ring 80 which may be formed of elastomeric material and have a half inch diameter circular cross-section. Grease seals 29 and 33 seat on the upstanding portion of lower end nut 27 which is shaped and dimensioned to cooperate with seals 29 and 33 to form an effective seal for the grease within bearing housing 40.

The preferred anti-friction bearing structure for the apparatus includes a double roller bearing assembly 34 with inner race, rollers and cages 39 and 41 for the lower and upper bearing portions respectively. A lubrication distributor 43 is mounted between the upper and lower bearing races; its structure can be better seen in the isometric view of FIG. 4. It is formed in two parts so that it is demountable from the roller bearing assembly and consists generally of a cylindrical band having at least two paddles 44 which extend from the outer surface and are inclined at an oblique angle so that they distribute the grease with which bearing housing 40 is packed. Paddles 44 are preferably inclined as shown in FIG. 4 so that upon clock-wise rotation of the rotating portion of the rotating head the grease will be propelled onto the upper bearing. This maintains proper lubrication for the upper bearing despite the tendency of the lubricant to gravitate to the bottom of the bearing housing.

A lower outer bearing race 35 is retained by the lower end plate 31 and an upper outer bearing race 37 is retained by a counterpart end plate 53. The roller bearing structure 34 is a special duty, double tapered roller bearing used as a combination radial and thrust bearing. It is a standard bearing available from Timpkin Bearing Corp., for example.

Top end plate 53 is secured to bearing housing 40 by cap screws 54 in a manner similar to that described for lower end plate 31. The top and bottom of housing 40 are provided with gaskets 51 and 45. Gasket 51 is similar to gasket 45 and each serves as a shim spacer as well as a sealing gasket. By the use of shim spacer-gaskets of different thickness the precise distance between lower end plate 31 and upper end plate 53 may be determined to properly locate outer races 35 and 37 and provide the proper operation of the double roller bearing 34. Top end plate 53 is provided with a seat 55 to accept a grease seal 57 corresponding to grease seal 29 or 33. Only one grease seal 57 is seated in top end plate 53 rather than the two seals 29 and 33 in bottom end plate 31. Bottom end plate 31 is also provided with a seat for the seals 29 and 33 but it is not visible in FIG. 2.

Top end nut 63 closes the top of housing 40 and is secured by threaded engagement with drive ring 61. Drive ring 61 is tapered to fit inside roller bearing 34. Top end nut 63 is similar to lower end nut 27 and provides the internal seat for grease seal 57. End nuts 27 and 63 with drive ring 31 form a tube which rotates with the Kelly tool therewithin. An additional dirt seal is provided at the top of the bearing housing 40 by an O-ring 80 identical to the O-ring 80 at the bottom of the housing.

Top end nut 63 has tapped openings to accept bolts 64 which securely connect drive rubber 65 to top end nut 63 by passing through openings in a metal flange 67 to which the elastomeric cylinder of drive rubber 65 is secured by adhesive or other suitable means. The rotating head drive bushing 72 engages the drive rubber 65 to cause the internal rotating parts of the rotating head to turn with the Kelly tool as previously described.

Bearing housing 40 is provided with a ⅜ths inch tapped opening closed by a standard pipe plug to provide an accessible opening for repacking the bearing housing with lubricating grease. An O-ring 78 fits under rim 49 to provide a seal with bowl flange 86.

The operation of the rotating head according to the invention will be generally understood from the previous description. However, to summarize the operation and reiterate certain of the advantages a typical sequence of operation will be described. All of the elements illustrated in FIG. 2 will be assembled as shown in FIG. 1, except for the rotating head drive bushing 72 and the sleeve 91. Normally there will be at least two substantially identical rotating head assemblies available so that one can be replaced for maintenance and/or reconditioning in a matter of minutes without significantly interrupting the drilling operation.

The sleeve 91 and the bowl flange 86 forming the top portion thereof will be welded or otherwise permanently secured at the top of the well conductor pipe and should not need to be removed during the course of the drilling operation. The rotating head drive bushing 72 on the other hand will be associated with the Kelly tool of the rig and although it may be readily replaced it will not normally need to be replaced with the rotating head assembly.

The rotating head assembly has a maximum outside diameter small enough to permit it to be raised through the opening in the center of the rig turntable. At the same time the opening in the top of the sleeve through the bowl flange 86 is large enough to accommodate the largest drill bit or other tool employed in the hole. Thus when the sleeve 91 and bowl flange 86 are secured in place on top of the conductor pipe the rotating head first may be put in place by disconnecting two sections of the drill pipe after which it may be lowered through the rig turntable into place on top of the bowl flange 86 where it is secured in position by locating blocks 87 to engage flange 49 and securely tightening nuts 89. Thenceforth the drill pipe is lowered into the well in conventional fashion and the rotating head drive bushing 72 is fitted on the Kelly tool 7 when the Kelly tool is put in place to commence the drilling operation. Rotating head drive bushing 72 also passes through the turntable and engages drive rubber element 65. Upon rotation of the Kelly tool by the rig turntable the rotating head drive bushing 72 threads into the drive rubber element 65 and rotates the rotatable portion of the rotating head. Thus all of the rotating elements and particularly the upper end nut, the drive ring 61, the lower end nut 27, and the stripper rubber 21, rotate with the Kelly tool.

If it is desired to remove or replace the rotating head assembly the procedure described above is reversed and when the rotating head assembly is pulled through the rig turntable it can be removed by disconnecting a section of the drill pipe. It is not necessary to pull more than one section of drill pipe to disconnect pipe and remove or replace the rotating head.

As seen from the above description there is no necessity to provide flowing lubricant to the rotating head and the almost inevitable loss of large quantities of lubricating oil is thereby avoided. If desired, lubricating grease can be added to the bearing housing without removing it from the position in the bowl flange. Alternatively the rotating head assembly may be removed in a matter of minutes and replaced with a newly lubricated, maintained, and/or reconditioned rotating head assembly.

The smooth running and well lubricated structure provided in the present rotating head reduces the force required to rotate the rotating head and makes it possible to provide a friction drive through the drive rubber element rather than a solid metal-to-metal contact drive arrangement. The drive rubber also acts as a shock absorber and vibration dampening element and provides smoother operation with reduced noise and vibration.

In addition to the variations and modifications to the apparatus which have been described and suggested above, it will be apparent to those skilled in the art that numerous other modifications and variations may be made in accordance with known techniques and procedures. Accordingly the scope of the invention is not to be considered limited to the particular embodiments and variations shown, described or suggested but is to be determined by reference to the appended claims.

What is claimed is:

1. An improved rotating head for rotary drilling rigs in which a rotatable Kelly tool of polygonal cross-section extends from the draw works through a turntable into the well pipe and is connected to the top of the drill pipe, said rotating head comprising, a housing adapted to be secured in sealing non-rotating relation to a well pipe, an antifriction bearing having an internal race with opening diameter greater than the external diameter of said drill pipe mounted in said housing, means for sealing lubricating grease in the space around said bearing within said housing, a rotatable tube with an internal diameter greater than the external dimension of drill pipe coaxial with the internal opening of said bearing and mounted to rotate with the inner race thereof, an elastomeric grommet member with an opening therethrough fixedly secured to the top of said tube, and a slide bushing with an internal opening adapted to slidably engage a Kelly tool and an external configuration producing a disengagable gripping action with the opening in said grommet member.

2. Apparatus as recited in claim 1 wherein said antifriction bearing is a combination thrust and radial double roller bearing.

3. Apparatus as recited in claim 1 further including a replaceable O-ring seal at the junction of the means for sealing lubricating grease in the space around said bearing and said elastomeric grommet member.

4. Apparatus as recited in claim 2 wherein said tube has a flange at the lower end thereof and further including a replaceable O-ring seal at the junction of said flange and the means for sealing lubricating grease in the space around said bearing.

5. An improved rotating head for rotary drilling rigs in which a rotatable Kelly tool of polygonal cross-section extends from the draw works through a turntable into the well pipe and is connected to the top of the drill pipe, said rotating head comprising, a housing adapted to be secured in sealing non-rotating relation to a well pipe, a roller bearing having an external race and an internal race with an opening diameter greater than the external diameter of said drill pipe mounted in said housing, said housing being in fixed relation with said external race, a tube with an internal diameter greater than the external dimension of drill pipe secured in the internal race of said bearing, a stripper rubber, means for securing said stripper rubber to the bottom of said tube, an elastomeric grommet member with an opening therethrough fixedly secured to the top of said tube, and a slide bushing with an internal opening adapted to slidably engage a Kelly tool and an external configuration producing a gripping action with the opening in said grommet member.

6. Apparatus as recited in claim 5 wherein said roller bearing is a combination thrust and radial bearing.

7. Apparatus as recited in claim 6 further including an O-ring seal at the junction of said housing and said elastomeric grommet member.

8. Apparatus as recited in claim 7 wherein said tube has a flange at the lower end thereof and further including an O-ring seal at the junction of said flange and said housing.

9. An improved rotating head for rotary drilling rigs in which a rotatable Kelly tool of polygonal cross-section extends from the draw works through a turntable into the well pipe and is connected to the top of the drill pipe, said rotating head comprising, a bottom section adapted to be fixedly secured to the top of a well pipe of predetermined diameter, and having an exit tube for connection to a blewie line, a housing adapted to be secured in sealing non-rotating relation to said bottom section, means for detachably securing said housing to said bottom section, a double roller bearing having an internal opening diameter greater than the external diameter of said drill pipe mounted in said housing, means for sealing lubricating grease in the space around said bearing within said housing, a tube with an internal diameter greater than the external dimension of drill pipe extending through the internal opening of said bearing, a stripper rubber, means for securing said stripper rubber to the bottom of said tube, an elastomeric grommet member with an opening therethrough fixedly secured to the top of said tube, and a slide bushing with an internal opening adapted to slidably engage a Kelly tool and an external configuration producing an disengagable gripping action with the opening in said grommet member.

10. Apparatus as recited in claim 9 wherein said roller bearing is a combination thrust and radial bearing.

11. Apparatus as recited in claim 10 wherein said means for detachably securing said housing includes a lip near the bottom thereof, a plurality of blocks on said bottom section rotatable to engage or disengage said lip, and means for releasably holding said blocks in engagement.

12. Apparatus as recited in claim 10 further including a replaceable O-ring seal at the junction of the means for sealing grease in the space around said bearing and said elastomeric grommet member.

13. An improved rotating head for rotary drilling rigs in which a rotatable Kelly tool of polygonal cross-section extends from the draw works through a turntable into the well pipe and is connected to the top of the drill pipe, said rotating head comprising, a bottom section adapted to be fixedly secured to the top of a well pipe of predetermined diameter, and having an exit tube for connection to a blewie line, a housing adapted to be secured in sealing non-rotating relation to said bottom section, means for detachably securing said housing to said bottom section, a double roller bearing having an internal opening diameter greater than the external diameter of said drill pipe mounted in said housing, means for sealing lubricating grease in the space around said bearing within said housing, a tube with an internal diameter greater than the external dimension of drill pipe extending through the internal opening of said bearing, a stripper rubber, means for securing said stripper rubber to the bottom of said tube, a top member fixedly secured to the top of said tube with an opening therethrough greater in diameter than the drill pipe external diameter, and a slide bushing with an internal opening adapted to slidably engage a Kelly tool and an external configuration non-rotationally engaging with the opening in said top member.

14. Apparatus as recited in claim 13 wherein said roller bearing is a combination thrust and radial bearing.

15. Apparatus as recited in claim 13 wherein said means for detachably securing said housing includes a lip near the bottom thereof, a plurality of blocks on said bottom section rotatable to engage or disengage said lip, and means for releasably holding said blocks in engagement.

16. Apparatus as recited in claim 13 further including a replaceable O-ring seal at the junction of the means for sealing grease in the space around said bearing and said top member.

17. Apparatus as recited in claim 13 wherein said double bearing is provided with inclined paddles located between the two internal races of said bearing for causing lubricant to be distributed to the upper section thereof.

* * * * *